United States Patent [19]

Gargaillo

[11] 4,096,727

[45] Jun. 27, 1978

[54] PUNCHING, STAMPING AND RIVETTING APPARATUS

[76] Inventor: Daniel Pierre Gargaillo, 71, rue Alexandre Boutin, Villeurbanne (Rhône), France

[21] Appl. No.: 681,755

[22] Filed: Apr. 29, 1976

[51] Int. Cl.[2] ..... B21D 28/26

[52] U.S. Cl. ..... 72/312; 72/328; 83/390; 83/639

[58] Field of Search ..... 72/391, 396, 465, 312, 72/327, 328; 29/243-254; 83/374, 375, 385, 386, 387, 389, 390, 639, 137; 91/411 A

[56] References Cited

U.S. PATENT DOCUMENTS

| | | | |
|---|---|---|---|
| 3,084,580 | 4/1963 | Schmid | 83/390 |
| 3,170,379 | 2/1965 | Dempster | 91/411 A |
| 3,555,949 | 1/1971 | Treff | 83/390 |
| 3,722,337 | 3/1973 | Brolund et al. | 83/639 |
| 3,777,540 | 12/1973 | Siebol et al. | 72/391 |
| 3,945,300 | 3/1976 | Bourges | 91/411 R |

*Primary Examiner*—Michael J. Keenan

[57] ABSTRACT

A hydraulic punch press having a base adapted to receive a workpiece and a cylinder axially disposed opposite to the base. The cylinder includes a first and second piston slidable defining within its interior, a first chamber formed between the surface of said first piston and one end of said cylinder and a second chamber formed between the first and second pistons. The pistons have coaxial rods extending outwardly of the other end of the cylinder in opposition to said base. The rod of the first piston extends axially through the rod of said second piston and carries at its end a tool while the rod of the second piston is tubular and is adapted to carry at its end holding means for the workpiece blank. Conduit means lead to each of the first and second chambers, from means for alternately delivering, simultaneously to said first and second chamber, hydraulic fluid of high pressure and lower pressure, respectively, to thereby reciprocate the rods of both pistons outwardly in a work phase, and the rod of the first piston inwardly in a retraction phase while maintaining the rod of said second piston in holding engagement with the workpiece blank and the workpiece holder is released and retracted when the second chamber is freed of hydraulic pressure fluid.

8 Claims, 11 Drawing Figures

PUNCHING, STAMPING AND RIVETTING APPARATUS

BACKGROUND OF THE INVENTION

The present invention relates to punch presses and, in particular, to presses for punching, stamping and rivetting work pieces.

During the formation of punches, e.g., holes, in metal parts, undesirable deformation of the work piece is often created. Such deformations may be only slight and easily avoidable when driving in the tool, and the subject work piece is clamped on a solid support. However, the situation is different when pulling the tool out, particularly in a rivetting operating, where the sheets to be connected are not pressed together.

In stamping operations in particular, it has been considered to provide a blank holder which is operative to hold the workpiece during driving in as well as pulling it out. Operating such a blank holder is nevertheless intricate and necessitates costly movable members. In punching operations considered as such, such retention of parts have usually not been considered. Holding the workpiece is also important in carrying out a rivetting operation on plural metal plates.

It is a primary object of the invention to provide a device which overcomes or at least mitigates against the disadvantages and shortcomings noted.

SUMMARY OF THE INVENTION

According to the present invention, a hydraulic punch press is provided comprising a base adapted to receive a workpiece and a cylinder axially disposed opposite to the base. The cylinder includes a first and second piston slidable defining within its interior, a first chamber formed between the surface of said first piston and one end of said cylinder and a second chamber formed between the first and second pistons. The pistons have coaxial rods extending outwardly of the other end of the cylinder in opposition to said base. The rod of the first piston extends axially through the rod of said second piston and carries at its end a tool while the rod of the second piston is tubular and is adapted to carry at its end holding means for the workpiece blank. Conduit means lead to each of the first and second chambers, from means for alternately delivering, simultaneously to said first and second chamber, hydraulic fluid of high pressure and lower pressure respectively the thereby reciprocate the rods of both pistons outwardly in a work phase, and the rod of the first piston inwardly in a retraction phase while maintaining the rod of said second piston in holding engagement with the workpiece blank and the workpiece holder is released and retracted when the second chamber is freed of hydraulic pressure fluid. In order to provide sufficient back stroke for the workpiece holder, resilient means are also interconnected to the piston attached to the workpiece blank holder so as to move the workpiece blank holder back into the cylinder. The high pressure fluid is preferably driven from a pump and the lower pressure fluid from an accumulator. A three-port slide valve is interposed between pump and accumulator on the one hand and the chambers on the other hand permitting, in three positions, direct connections, crossed connections and a direct connection between the second chamber and accumulator as well as a drain connection for the aforesaid space.

An easy operation is thereby provided, as well as improved working conditions and increased functioning safety.

Full details of the present invention are set forth in the following description of the preferred embodiments taken in conjunction with the accompanying drawings.

BRIEF DESCRIPTION OF THE DRAWINGS

FIG. 3 is a further cross-sectional view of the press with tool driven in;

DESCRIPTION OF THE INVENTION

Figure 1:
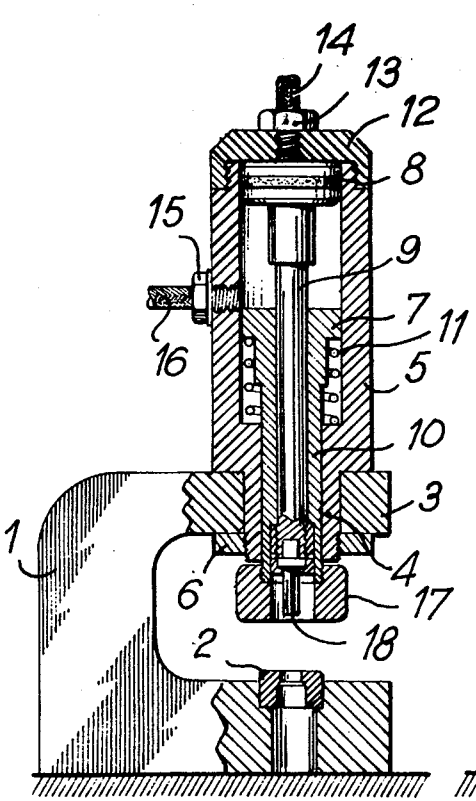
FIG. 1 is a cross-sectional view of a press with its tool and workpiece blank holder retracted.

As shown on FIG. 1, the punching tool comprises a "C" shaped vertical base member 1 with a die 2 mounted on the lower portion thereof while the upper portion 3 fixedly receives the shouldered end 4 of a cylinder block 5 secured by a screw 6. This cylinder block 5 contains two pistons 7, 8, the piston rod 8 being provided with an elongated rod member 9 extending co-axially through the tubular rod member 10 of piston 7. The piston 7 is engaged with a spring 11 located between the flange end of the piston and the opposite bottom of cylinder 5.

As seen, the piston defines within the cylinder a first chamber formed with the first or upper piston 8 and the lid 12, and a second chamber formed intermediate both pistons 7 and 8.

An insertable upper lid 12 is provided to close the cylinder 5. The lid 12 is provided with a connecting adaptor 13 for a hydraulic fluid pipe 14. Cylinder 5 is also provided on its lateral face with a connecting adaptor 15 for a hydraulic pipe 16. The lateral inlet to the cylinder (i.e., adaptor 15) is located above the head of the piston 7 when the piston is stopped at its highest return position within the cylinder.

The tubular rod 10 receives at its lower end 4 a workpiece blank holder 17 while the lower end of stem 9 receives and keeps attached a punch 18 in conjunction with die 2.

Figures 4, 5, 6, 7, 8, 9, 10, 11:
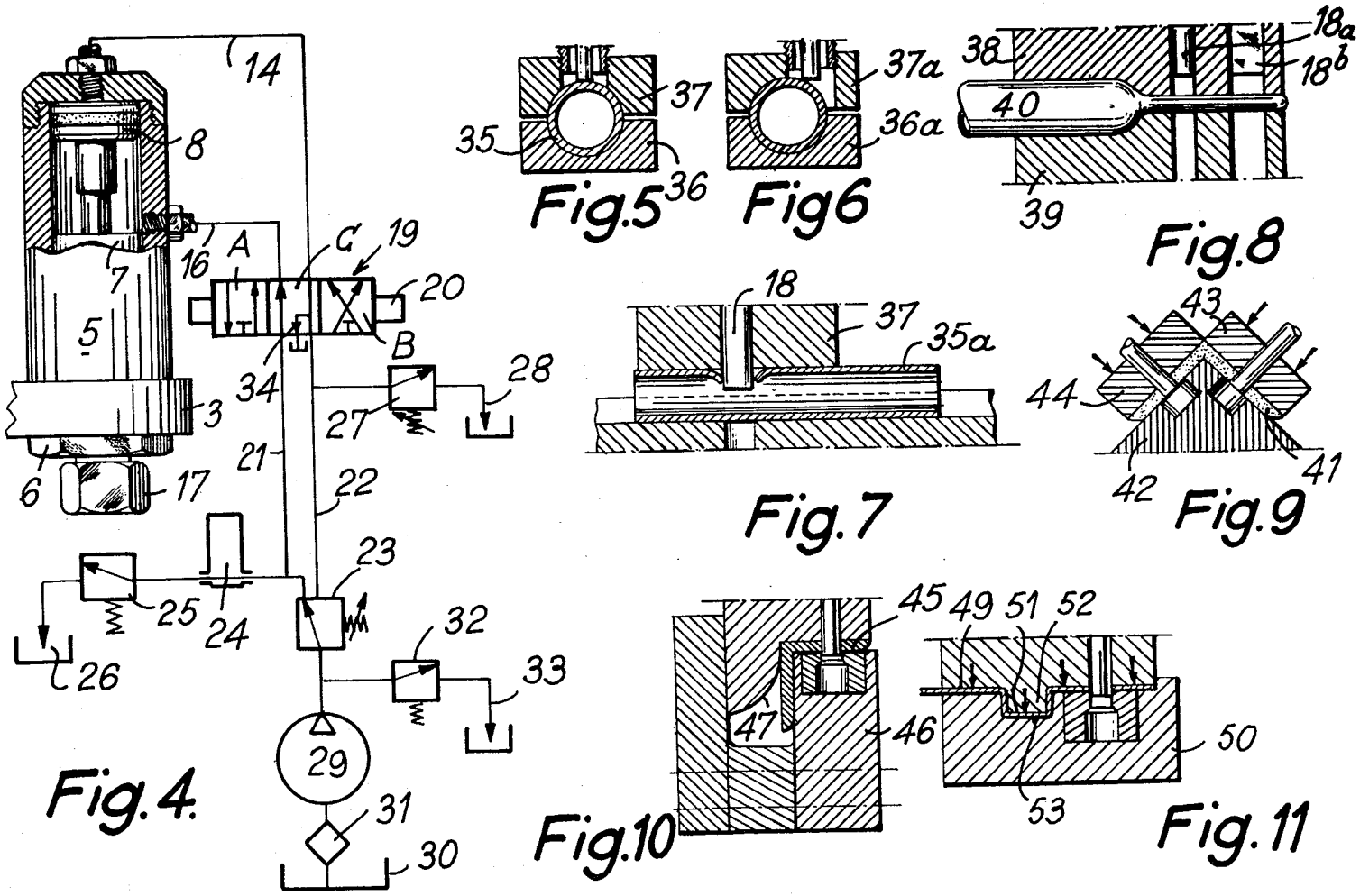
FIG. 4 is a hydraulic diagram for the supply of the hydraulic fluid.
FIGS. 5 to 11 are various schematic views of workpiece blank holder embodiments.

As shown on FIG. 4, conduit pipes 14 and 16 are connected to a slide valve 19 whose moving body can be positioned in three locations. The main body of valve 19 is connected by a pipe 21 and by a pipe 22 parallel to both outlets of a hydraulic switch 23 with adjustable load which will be described hereinbelow. The corresponding outlet of pipe 21 is connected to a hydraulic accumulator 24 and to a gauged relief valve 25 with return 26 to the tank reservoir.

Pipe 22 is connected via an adjustable relief valve 27, a return 28 to the tank reservoir.

The inlet of valve 23 is connected to the exhaust opening of a pump 29 drawing from the tank reservoir through a filtering strainer 31. The exhaust of pump 29 is connected via a gauged relief valve 32 and an associated return 33 to the tank reservoir.

The first position (work position) of the moving body 20 of the slide valve, labeled A on the diagram, corresponds to direct connections between pipes 21 and 16 on the one hand, and 22 and 14 on the other hand.

The second position (retract position), labeled B, corresponds to crossed connections of pipe 21 to pipe 14 and pipe 22 to pipe 16, respectively.

The third position (rest position), labeled C, corresponds as regards its connections to a situation identical to that of position A but with both pipes 14 and 22 connected to the tank reservoir by discharge by-pass 34.

Figure 3:
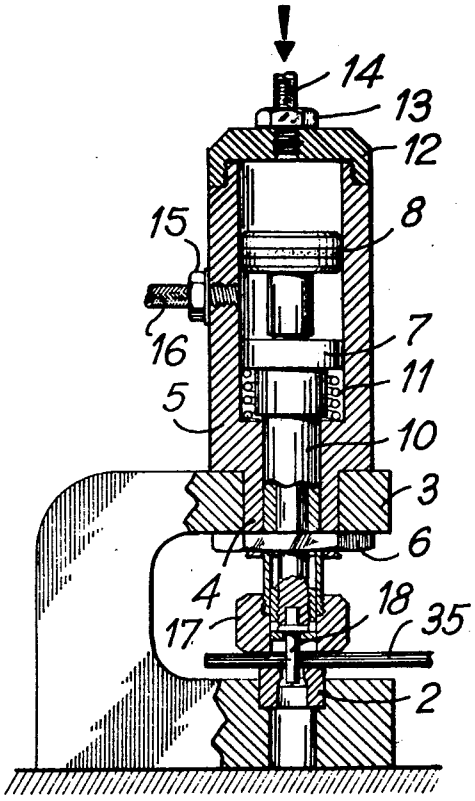
Figure 2:
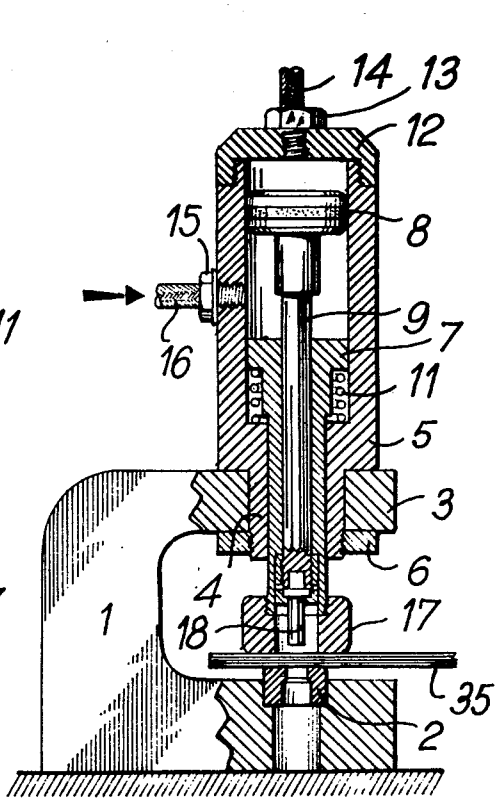
FIG. 2 is a similar cross-sectional view of the press when applying the workpiece blank holder.

Such a device operates as follows: with pump 29 placed in operation, the valve 23 directs the flow of hydraulic fluic towards accumulator 24 which becomes loaded to a pressure established by valve 27. The moving body 20 of the slide valve 19 is in the rest position C where pipe 14 is connected to the tank reservoir by by-pass 34 and the second chamber to the accumulator 24. If the moving body 20 of valve 19 is shifted to position A, the first chamber within the cylinder above piston 8 is connected to the pump via pipes 22 and 14, as is the second chamber, i.e., between the pistons, via pipe 21 with 16. As pressure rises in pipe 22 and therefore in valve 23, the latter tips over, isolates the accumulator 24 from pump 29 and keeps only the 22, 14 connection between the accumulator and the second chamber. The pressure of accumulator 24 is applied to this second chamber between the two pistons 7 and 8, and drives the piston 7 down against spring 11. The workpiece blank holder 17 is therefore pressed onto the workpiece illustrated by metal plate 35 to be punched (FIG. 2). As pressure develops inside pump 29, it acts through the first chamber on piston 8 which drives it down forcing back the fluid within the second chamber via conduit 16 to accumulator 24 where the pressure cannot exceed the limit value of valve 25. Punch 18 then drives through the plate 35 which is maintained during this maneuver pressed between the die 2 and the workpiece blank holder 17. As pistons 7 and 8 reach the end of their downward strokes, any dangerous over-pressure is avoided by valves 27 and 32.

The moving body 20 of valve 19 is now brought to position B, which reverses the connections to pump and accumulator, thus bringing the pressure of the fluid in the second chamber between pistons 7 and 8 to a value equal to that of the discharge of the pump 29. Piston 8 is lifted so that punch 18 pulls out of plate 35 without release of the action of blank holder 17 since even, on the contrary, with an increased action of the piston 8, it is only subject to the limit pressure of accumulator 24. The up stroke of piston 8 is then ensured since the pressure in the fluid in the second chamber becomes as a matter of fact greater in this situation than the limit pressure of the accumulator and maintains its fixed position relative to the piston 8.

The lifting of the workpiece blank holder 17 is obtained by bringing the moving body 20 of valves 19 in the C position. In this situation, the fluid in the second chamber is still maintained at the pressure of accumulator 24, but the fluid in the first chamber above the upper face of piston 8 is connected to the discharge tank by by-pass 34 so that both pistons are pushed back towards the upper inserted lid 12 by spring 11 whose action is then preponderant, until complete release of said spring, a situation in which the upper face of the annular piston 7 remains below the outlet of connection 15. Under these conditions, piston 8 is first driven by the shoulder of stem 9 and then accumulator 24 and pump 29 supply under said piston 8, in the fluid of the second chamber, in order to increase it up to the abutment of said piston 8 on the upper inserted lid 12.

It can be seen under these conditions that the drive of punch 18 is complete in both in and out phases, whereas the workpiece blank holder remains in position until its release is also operated. The ease and accuracy of work is greatly increased.

Of course, and as shown on FIGS. 5 to 11, the ease provided to this complete drive of the subject device makes it capable of other works than the simple punching of metal plates. Working on tubes 35 can be made with a grooved die 36 and grooved blank holder 37 in conjunction with it (ref. FIGS. 5, 6 and 7). In FIG. 7, a tube **37*a* can be punched right through. Such a tube is not subject to any cambered deformation when the punch is pulled out and the walls can only be deformed towards the inside around the punching openings. In FIG. 6, in particular, grooves 36*a* and 37*a* are excentered in relation to the axis of punch 18**, and provide a hold which avoids sideslip when the tool is presented to the tube.

As shown in FIG. 8, the workpiece blank holder 38 and die 39 could form partially holding grooves for tube 40 and partially also crunching jaws for the tube around the part to be punched, punching tool **18*a* being then used in conjunction with a cutting tool 18*b*** which cuts out the crunched part of the tube around the punched opening opposite cutting portions of the die.

FIG. 9 shows a conjunction of two tools of such type, adapted for a simultaneous or non-simultaneous punching on two sides of a corner piece 41 maintained straddling on a dihedral die by the two blank holders 43 and 44.

The workpiece blank holder can also be arranged as is shown in FIG. 10 in order to block the part to be worked 45 onto die 46, axially and transversely simultaneously by cooperation of an inclined surface 47 which pushes back the part to be worked in side abutment onto die 46. As shown in FIG. 11, the blank holder 48 can also provide a transverse hold on the part to be worked 49 onto die 50 by stamping in particular a rib 51 between an embossing 52 and the blank holder and an imprint 53 of the die holder 50 or conversely.

It is to be understood that without departing from the scope of this invention, it is possible to modify the embodiments described hereinabove. For instance and instead of a hydraulic action on the upper piston 8, an extended piston-rod could be provided extending through the upper lid of the cylinder and it would then be possible to apply the punching force on the end of said piston-rod by any appropriate means. It is also to be understood that the applications of the invention are not limited to the punching technique and on the contrary can be applied to stamping and rivetting. More particularly in such a case, retaining means for preventing the tool from rotating can be provided, by way in particular of long keys mounted on part at least of the piston rod guides, or on the pistons themselves.

The independent driving mechanisms for the subject tools can comprise hydraulic press members whose driving fluid can be utilized for creating the aforesaid fluid chamber by an appropriate by-pass. A hydraulic accumulator is not a necessity and can be replaced by a set of valves and a pressure pump with varying supply for instance, or with adjustable relief-escape-valve.

I claim:

1. A hydraulic punch press comprising a base adapted to receive a workpiece, a cylinder axially disposed opposite to said base, first and second pistons slidably mounted within said cylinder and defining therewithin a first chamber formed between the upper surface of said first piston and one end of said cylinder and a second chamber formed between the first and second pistons, said pistons having coaxial rods extending outwardly of the other end of said cylinder in opposition to said base, the rod of the first piston extending axially through the rod of said second piston and being adapted to carry at its free end a tool, the rod of said second piston being tubular and being adapted to carry at its end holding means for the workpiece, conduit means leading to each of said first and second chambers, and means for alternately delivering simultaneously to said first and second chambers hydraulic fluid of high pressure and lower pressure respectively to thereby sequentially reciprocate the rods of both said pistons outwardly in a work phase in which said workpiece holding means engages the workpiece prior to the tool and said rod of said first piston inwardly in a retraction phase while maintaining the rod of said second piston in holding engagement with said workpiece.

2. The press according to claim 1 including a compression spring interposed between said second piston and the end of said cylinder for resiliently biasing said second piston towards the interior of said cylinder, and means for relieving the hydraulic fluid in said second chamber.

3. The press according to claim 1 wherein said means for delivering said hydraulic fluid comprises a slide valve connected to a source of fluid under high pressure, a source of fluid under a constant pressure lower than said high pressure, and a discharge tank, said slide valve having three positions, (a) a first work position in which the first chamber is connected to the source of high fluid pressure and the second chamber is connected to the source of constant lower fluid pressure;

(b) a second retraction of position in which the first chamber is connected to the source of constant lower fluid pressure and the second chamber is connected to the source of high fluid pressure;

(c) a third inoperative position in which the first chamber is connected to the tank and the second chamber is connected to the source of constant lower fluid pressure.

4. The press according to claim 3 wherein said high pressure fluid source is a pump and said lower pressure fluid source is an accumulator.

5. The press according to claim 3 including pressure limiting valves interposed between said slide valves and said high pressure fluid source and said low pressure fluid source.

6. The press according to claim 1 wherein the workpiece holder and the base have complementary formed means to cooperatively hold the workpiece.

7. The press according to claim 6 including means to prevent rotation of said tool.

8. The press according to claim 1, in which the holder piston has an extended piston-rod emerging from the cylinder, on which, by a mechanical means external of the cylinder, a force at least partially constituting the force actuating the tool in its work stroke can be applied.

* * * * *